US007870003B2

(12) United States Patent
Yamamoto et al.

(10) Patent No.: US 7,870,003 B2
(45) Date of Patent: Jan. 11, 2011

(54) ACOUSTICAL-SIGNAL PROCESSING APPARATUS, ACOUSTICAL-SIGNAL PROCESSING METHOD AND COMPUTER PROGRAM PRODUCT FOR PROCESSING ACOUSTICAL SIGNALS

(75) Inventors: Koichi Yamamoto, Kanagawa (JP); Akinori Kawamura, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1081 days.

(21) Appl. No.: 11/376,130

(22) Filed: Mar. 16, 2006

(65) Prior Publication Data

US 2006/0235680 A1 Oct. 19, 2006

(30) Foreign Application Priority Data

Apr. 14, 2005 (JP) ..... 2005-117375

(51) Int. Cl.
*G10L 21/04* (2006.01)

(52) U.S. Cl. ..... 704/503; 381/22

(58) Field of Classification Search ..... 704/503; 381/22

See application file for complete search history.

(56) References Cited

U.S. PATENT DOCUMENTS

| | | | | |
|---|---|---|---|---|
| 6,487,536 | B1 | 11/2002 | Koezuka et al. | |
| 2004/0161116 | A1 * | 8/2004 | Tsuji et al. | 381/22 |
| 2005/0010398 | A1 | 1/2005 | Nagayasu et al. | |

FOREIGN PATENT DOCUMENTS

| | | |
|---|---|---|
| JP | 62-203199 | 9/1987 |
| JP | 2905191 | 3/1999 |
| JP | 2002-297200 | 11/2002 |
| JP | 3430968 | 5/2003 |
| JP | 3430974 | 5/2003 |
| JP | 2004-309893 | 11/2004 |
| JP | 08/265697 | 11/2006 |

OTHER PUBLICATIONS

Time-Scale Modification Algorithm for Speech by use of Pointer Interval Control Overlap and Add (PICOLA) and It's Evaluation, Morita et al. (1986) pp. 149-150 (with machine generated English translation).

Luca Armani, Maurizio Omologo, Weighted Autocorrelation-Based F0 Estimation for Distant-Talking Interaction With a Distributed Microphone Network, ITC-irst (Centra per la Ricerca Scientifica e Tecnologica) I-38050 Povo-Trento (Italy), IEEE 2004 pp. 1-113 to 1-116.

* cited by examiner

*Primary Examiner*—David R Hudspeth
*Assistant Examiner*—Justin W Rider
(74) *Attorney, Agent, or Firm*—Oblon, Spivak, McClelland, Maier & Neustadt, L.L.P.

(57) ABSTRACT

An acoustical-signal processing apparatus includes a feature extracting unit that extracts feature data common to each channel signal which forms a multichannel acoustical signal, based on a composite similarity obtained by combining similarities calculated from each channel signal; and a time-base companding unit that executes time compression and time expansion of the multichannel acoustical signal based on the extracted feature data.

17 Claims, 6 Drawing Sheets

ACOUSTICAL-SIGNAL PROCESSING APPARATUS, ACOUSTICAL-SIGNAL PROCESSING METHOD AND COMPUTER PROGRAM PRODUCT FOR PROCESSING ACOUSTICAL SIGNALS

CROSS-REFERENCE TO RELATED APPLICATIONS

This application is based upon and claims the benefit of priority from the prior Japanese Patent Application No. 2005-117375, filed on Apr. 14, 2005; the entire contents of which are incorporated herein by reference.

BACKGROUND OF THE INVENTION

1. Field of the Invention

The present invention relates to an apparatus, a computer program product, and a method for processing acoustical-signal, by which time compression and time expansion of multichannel acoustical signals is executed.

2. Description of the Related Art

Conventionally, a desired companding ratio has been realized by extracting feature data such as a fundamental frequency from an input signal, and by inserting and deleting a signal with an adaptive time width which is decided based on the obtained feature data, when the time length of an acoustical signal is changed, for example, in speech-rate conversion. For example, a "Pointer Interval Controlled OverLap and Add" (PICOLA) method described by MORITA Naotaka and ITAKURA Fumitada, "Time companding of voices, using an auto-correlation function", Proc. of the Autumn Meeting of the Acoustical Society of Japan, 3-1-2, p. 149-150, October, 1986 is a typical time companding method. In this PICOLA, the time companding is processed by extracting a fundamental frequency from an input signal, and by inserting and deleting waveforms of the obtained fundamental frequency. In Japanese Patent No. 3430968, a waveform is cut out at a position at which waveforms in a crossfade interval are the most similar to each other, and the both ends of the cut waveforms are connected for time companding processing. In the both techniques, companding processing is executed, based on feature data representing a similarity between two intervals which are separated in the time-base direction of an original signal, and time-base compression and time-base expansion processing can be naturally realized without changing musical intervals.

Incidentally, in the case where an acoustical signal to be processed is an acoustical signal of a multichannel type such as a stereo signal and a 5.1 channel signal, feature data such as a fundamental frequency, which are extracted from each channel, are not necessarily the same, as one another when time-base companding is separately executed for each channel, and cause a state in which timing for insertion and deletion of waveforms are different from one another. Thereby, there has been a problem that a phase difference which is not included in the original signal is caused between signals after the processing, and discomfort is felt by audiences.

Then, in the speech-rate conversion of a multichannel acoustical signal, synchronization between the channels is required for keeping sound-source localization by insertion and deletion of waveforms, based on a common feature (common pitch), after extracting the feature (common pitch) common to all channels. Conventional techniques, by which a feature common to all channels (common pitch) is extracted and synchronization between the channels is secured as described above, are for example those described in Japanese Patent No. 2905191, and Japanese Patent No. 3430974. According to these techniques, a feature (common pitch) is extracted from signals combining (adding) all or a part of multichannel acoustical signals. For example, when an input signal is a stereo signal, a feature common to all channels is extracted from (L+R) signals obtained by combining (adding) L channels and R channels.

However, the method, by which a feature common to all channels is extracted from signals combining (adding) multichannel acoustical signals as described above, has a problem that a feature (common pitch) cannot be accurately extracted when there is included a sound having a component of a left channel out of phase with that of a right channel at combining (adding) a plurality of channel signals are combined (added). More particularly, there has been a problem that the both signals cancel each other (the both become 0 in the case of the same amplitude), and the feature (common pitch) cannot be accurately extracted when an L channel and an R channel in a stereo signal have signals in out of phase with each other, and the both signals are combined (added) in the form of (L+R).

SUMMARY OF THE INVENTION

According to one aspect of the present invention, an acoustical-signal processing apparatus includes a feature extracting unit that extracts feature data common to each channel signal which forms a multichannel acoustical signal, based on a composite similarity obtained by combining similarities calculated from each channel signal; and a time-base companding unit that executes time compression and time expansion of the multichannel acoustical signal based on the extracted feature data.

According to another aspect of the present invention, a computer program product having a computer readable medium including programmed instructions for processing an acoustical-signal causes the computer to perform extracting feature data common to each channel signal which forms a multichannel acoustical signal, based on a composite similarity obtained by combining similarities calculated from each channel signal; and executing time compression and time expansion of the multichannel acoustical signal based on the extracted feature data.

According to still another aspect of the present invention, an acoustical-signal processing method includes extracting feature data common to each channel signal which forms a multichannel acoustical signal, based on a composite similarity obtained by combining similarities calculated from each channel signal; and executing time compression and time expansion of the multichannel acoustical signal based on the extracted feature data.

DETAILED DESCRIPTION OF THE PREFERRED EMBODIMENTS

Hereinafter, an acoustical-signal processing apparatus, an acoustical-signal processing program, and a method of acoustical-signal processing according to most preferred embodiments of the present invention will be explained in detail, referring to drawings.

A first embodiment according to the present invention will be explained, referring to FIG. 1 through FIG. 3. This embodiment is an example in which a multichannel acoustical-signal processing apparatus is applied as an acoustical-signal processing apparatus, wherein an acoustical signal to be processed is of a stereo type, and the multichannel acoustical-signal processing apparatus is used when the tempo of music is changed or a speech rate is changed.

Figure 1:
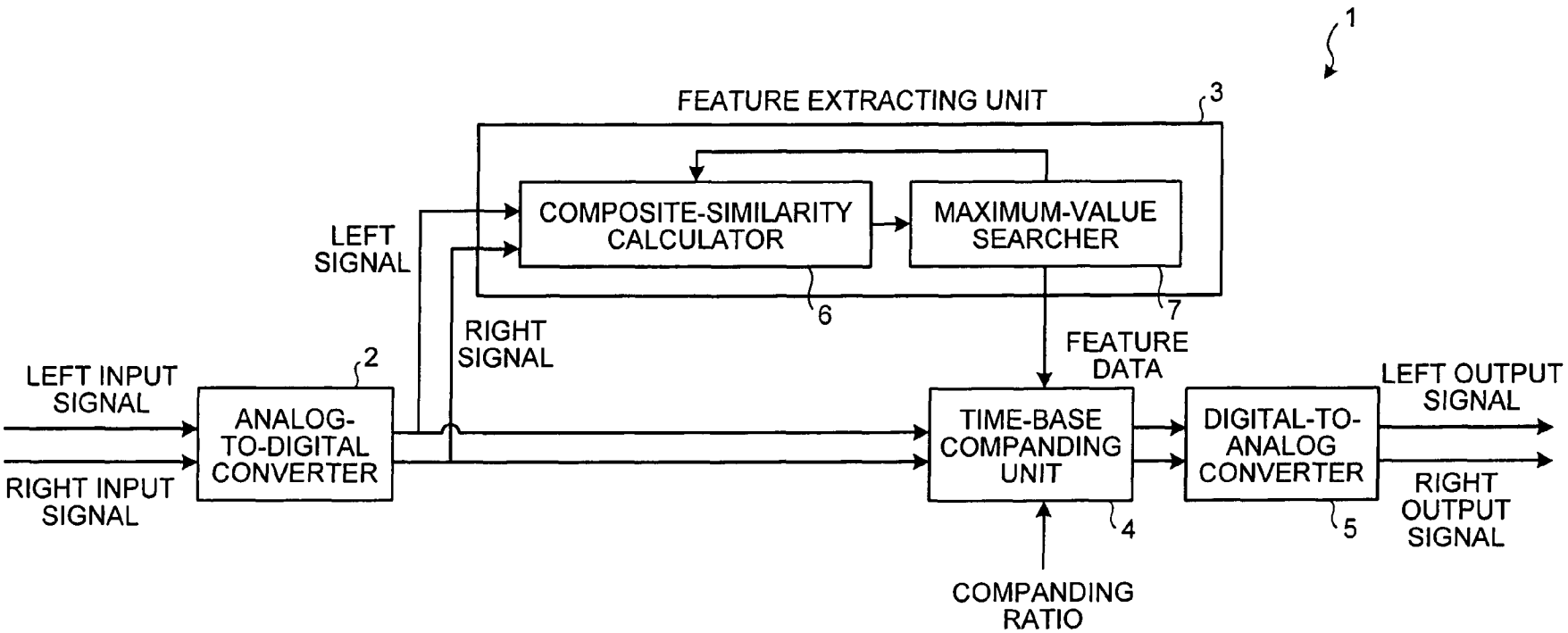
FIG. 1 is a block diagram showing a configuration for an acoustical-signal processing apparatus according to a first embodiment of this invention.

FIG. 1 is a block diagram showing a configuration for an acoustical-signal processing apparatus 1 according to the first embodiment of this invention. As shown in FIG. 1, the acoustical-signal processing apparatus 1 comprises: an analog-to-digital converter 2 for analog-to-digital conversion of a left input signal and a right input one at a predetermined sampling frequency; a feature extracting unit 3 for extracting a feature common to the both channels from a left signal and a right one, which are output from the analog-to-digital converter 2; a time companding unit 4 which performs, based on the feature data extracted in the feature extracting unit 3 and is common to the left and right channels, time-base companding processing of the input original digital signal, according to a specified companding ratio: and a digital-to-analog converter 5 which outputs the left output signal and the right output one obtained by digital to analog conversion of digital signals of each channel after processed in the time-base companding unit 4.

The feature extracting unit 3 comprises: a composite-similarity calculator 6 for calculating a composite similarity by using the left and right signals; and a maximum-value searcher 7 for determining a search position at which the composite similarity obtained in the composite-similarity calculator 6 is maximum.

A Pointer Interval Controlled Over Lap and Add (PICOLA) method is used for time base companding in the time base companding unit 4. In the PICOLA method, as described by MORITA Naotaka and ITAKURA Fumitada, "Time companding of voices, using an auto-correlation function", the Proc. of the Autumn Meeting of the Acoustical Association of Japanese, 3-1-2, p. 149-150, October, 1986, a desired companding ratio is realized by extracting a fundamental frequency from the input signal, and repeating insertion and deletion of waveforms of the obtained fundamental frequency. Here, when R is defined by a time-base companding ratio expressed by (time length after processing/time length before processing), R falls within the following range: $0<R<1$ in the case of compression processing; and a range of $R>1$ in the case of expanding processing. Though the PICOLA method is used as the time-base companding method in the time-base companding unit 4 according to this embodiment, the time-base companding method is not limited to the PICOLA method. For example, a configuration in which a waveform is cut out at a position at which waveforms in a crossfade interval are the most similar to each other, and the both ends of the cut waveforms are connected for time companding processing may be applied.

Subsequently, procedures in the acoustical-signal processing apparatus 1 will be explained.

First, each of the left input signal and the right input one, which are a stereo signal to be subjected to time-base companding processing, are converted from an analog signal to a digital signal in the analog-to-digital converter 2.

Then, in the feature extracting unit 3, a fundamental frequency common to the left channel and the right one is extracted from the left digital signal and the right digital one converted in the analog-to-digital converter 2.

In the composite-similarity calculator 6 of the feature extracting unit 3, the composite similarity between two intervals separated in the time direction is calculated for the left digital signal and the right digital one from the analog-to-digital converter 2. The composite similarity can be calculated based on equation (1):

$$S(\tau) = \sum_{n=0, n+=\Delta n}^{N-1} (x_l(n) \cdot (x_l(n+\tau) + x_r(n+\Delta d) \cdot x_r(n+\Delta d+\tau)) \quad (1)$$

where, $X_1(n)$ represents a left signal at time n, $X_r(n)$ represents a right signal at time n, N represents a width of a waveform window for calculation of the composite similarity, $\tau$ represents a search position for a similar waveform, $\Delta n$ represents a thinning-out width for calculation of the composite similarity, and $\Delta d$ represents a displacement in the thinning-out width between the left channel and the right one.

In equation (1), the composite similarity between two waveforms separated in the time direction is calculated, using an auto-correlation function. $s(\tau)$ represents the sum of the values of the auto-correlation function for a left signal and a right one at a search position $\tau$, that is, represents the composite similarity obtained by combining (adding) the similarities of each channel. The larger composite similarity $s(\tau)$ causes the higher average similarity between a waveform with a length of N from time n as a starting point, and a waveform with a length of N from time $n+\tau$ as a starting point for a left channel and a right one. The window width N of a waveform for composite-similarity calculation is required to be at least a width of the lowest frequency of fundamental frequencies to be extracted. For example, when it is assumed that a sampling frequency for analog to digital conversion is 48,000 hertz, and a lower limit of a fundamental frequency to be extracted is 50 hertz, the window width N of a waveform becomes 960 samples. As shown in equation (1), when a composite similarity acquired by combining similarities obtained from each channel is used, the similarity can be accurately expressed even when there is included a sound in opposite phase to each other between those of a left channel and a right one.

Moreover, the similarity for each channel is calculated at intervals of $\Delta n$ in equation (1) in order to reduce the amount of calculations. $\Delta n$ represents a thinning-out width for similarity calculation, and, when this value is set at a larger value, the amount of calculations can be reduced. For example, when the companding ratio is one or less (compression), the amount of calculations for short time, which is required for conversion processing, is increased. Thereby, when the companding ratio is one or less, $\Delta n$ is set as five samples through ten samples as the companding ratio approaches one, and a configuration in which $\Delta n$ approaches one sample may be applied. In the composite-similarity calculation, it is sufficient to understand a broad perspective of differences in the amplitudes, and the sound quality after time-base companding is not remarkably decreased even when samples are thinned out for calculation as described above. Moreover, $\Delta n$ may be decided according to the number of channels. Because an amount of calculations required for extracting features is increased when the number of channels is increased like the 5.1 channels. For example, the amount of calculations can be reduced by making the number of samples for $\Delta n$ equivalent to the number of channels even when the 5.1 channel signal is processed.

$\Delta d$ in equation (1) represents the width of a position displacement between a left channel and a right one for thinning-out processing. This is for decreasing reduction in the time resolution by executing thinning-out processing at different positions for left and right channels. Setting the displacement width $\Delta d$, for example, at $\Delta n/2$ is equivalent to similarity calculation with a thinning-out width of $\Delta n/2$ alternately for a left channel and a right one in equation (1). As described above, it is possible to decrease reduction in the time resolution for all channels by executing thinning-out processing at different positions for each of multichannels. The displacement width between channels may be changed according to the number of channels in the same manner as $\Delta n$. When the 5.1 channel signal is processed, setting $\Delta d$ for each channel, for example, at 0, $\Delta n \times 1/6$, $\Delta n \times 2/6$, $\Delta n \times 3/6$, $\Delta n \times 4/6$, and $\Delta n \times 5/6$ is equivalent to similarity calculation with a thinning-out width of $\Delta n/6$ alternately for six channels in all. Accordingly, it is possible to decrease reduction in the time resolution for all channels.

In the maximum-value searcher 7 of the feature extracting unit 3, a search position $\tau_{max}$, at which a composite similarity becomes the maximum, is searched in a range for searching a similar waveform. When the composite similarity is calculated by equation (1), it is required only to search for the maximum value of $s(\tau)$ between a predetermined start position $P_{st}$ for searching and a predetermined end position $P_{ed}$ for searching. For example, when it is assumed that a sampling frequency for analog to digital conversion is 48,000 hertz, an upper limit of a fundamental frequency to be extracted is 200 hertz, and a lower limit of the frequency to be extracted is 50 hertz, the search position $\tau$ for the similar waveform is between 240 samples through 960 samples, and $\tau_{max}$ which maximizes $s(\tau)$ in the range is obtained. The $\tau_{max}$ obtained as described above is a fundamental frequency common to the both channels. Even when the maximum value is searched as described above, the thinning-out processing can be applied. That is, a search position $\tau$ for a similar waveform in the time-base direction is changed from the start position $P_{st}$ for searching to the end position $P_{ed}$ for searching in $\Delta\tau$. $\Delta\tau$ represents the thinning-out width in the time-base direction for similar-waveform search, and, when the value is set large, the amount of calculations can be reduced. The value of $\Delta\tau$, can be effectively reduced by changing the number of the companding ratios and the number of channels in a similar manner to that for the above-described $\Delta n$. For example, when the companding ratio is one or less, the $\Delta\tau$ is set as five samples through ten samples, and, as the companding ratio approaches one, a configuration in which $\Delta\tau$ approaches one sample may be applied.

Here, when there is enough capacity for the amount of calculations, it is natural that detailed composite similarity calculation and searching for the maximum value can be executed, assuming that the thinning-out width $\Delta n$, and $\Delta\tau$ are one sample, though reduction in the amount of calculations has been noted in the above-mentioned explanation.

Figure 2:
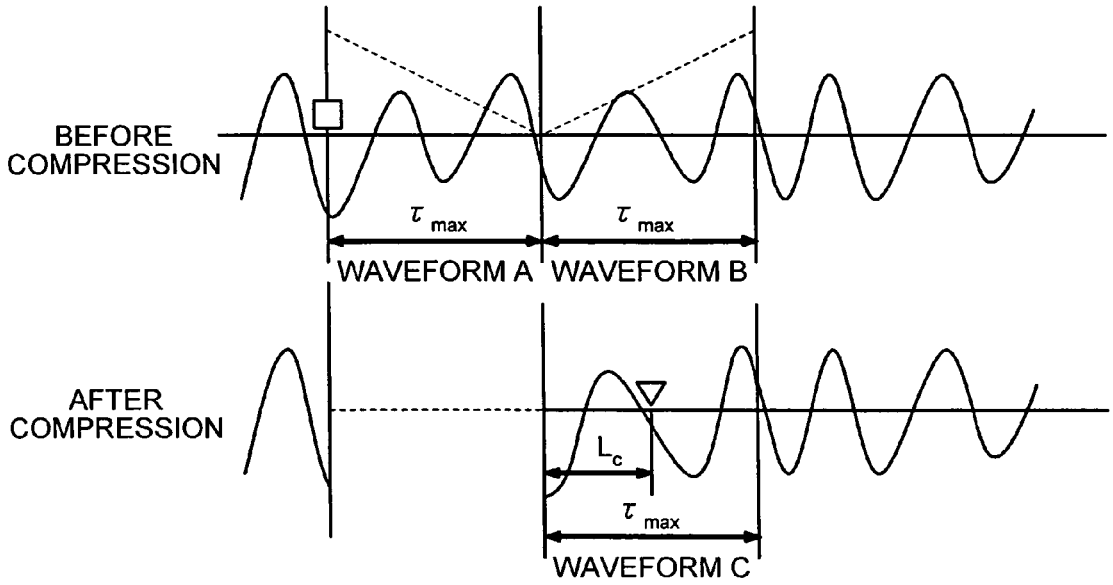
FIG. 2 is an explanatory view showing waveforms of voice signals undergoing time-base compression according to the PICOLA method.

In the time-base companding unit 4, time-base companding of left and right signals is processed, based on the fundamental frequency $\tau_{max}$ obtained in the feature extracting unit 3. FIG. 2 is a view showing waveforms of voice signals for time-base compression (R<1) according to the PICOLA method. First, a pointer (represented with a square mark in FIG. 2) is set at a start position for time-base compression as shown in FIG. 2, and a basic frequency $\tau_{max}$ in the voice signal from the pointer forward is extracted in the feature extracting unit 3. Subsequently, a signal C is generated, wherein the signal C is obtained by overlap-and-add operation weighted in such a way that two waveforms A and B at a distance of the basic frequency $\tau_{max}$ from the above-described pointer position are crossfaded. Here, a waveform C with a length of $\tau_{max}$ is generated by assigning a weight to the waveform A in such a way that the weight is linearly changed from one to zero, and by assigning a weight to the waveform B in such a way that the weight is linearly changed from zero to one. This crossfade processing is provided for continuity for connecting points at the front and rear ends of the waveform C. Then, the pointer is moved by $$L_c = R\tau_{max}/(1-R)$$

on the waveform C, and is assumed to be a start point for the subsequent processing (shown by an inverse triangle in FIG. 2). It is understood that the output waveform with a length of $L_c$ is made by the above-described processing, based on the input signal with a length of $L_c+\tau_{max}=\tau_{max}/(1-R)$ to meet the companding ratio R.

Figure 3:
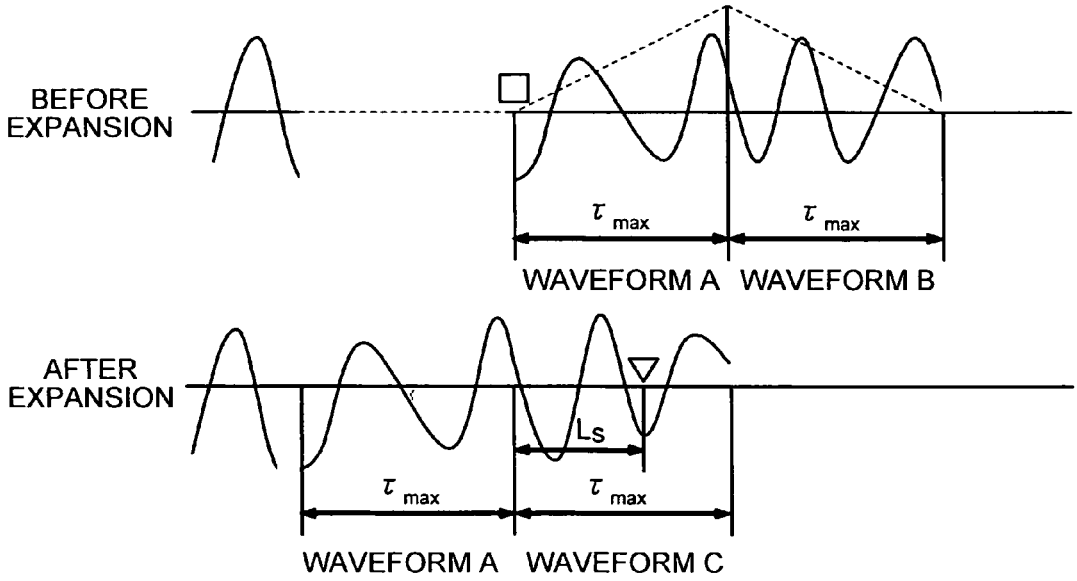
FIG. 3 is an explanatory view showing waveforms of voice signals undergoing time-base expansion according to the PICOLA method.

On the other hand, FIG. 3 is a view showing waveforms of voice signals for time-base expansion (R>1) according to the PICOLA method. In the expansion processing, in the same manner as that of the compression processing, a pointer (represented with a square mark in FIG. 3) is set at a start position for time-base compression as shown in FIG. 3, and then a basic frequency in the voice signal from the pointer forward is extracted in the feature extracting unit 3. Two waveforms at a distance of the basic frequency $\tau_{max}$ from the above-described pointer position are assumed to be A, and B. In the first place, the waveform A is output as it is. Subsequently, a waveform C with a length of $\tau_{max}$ is generated by superimpose-add operation with a weight assigned to the waveform A in such a way that the weight is linearly changed from zero to one, and by superimpose-add operation with a weight assigned to the waveform B in such a way that the weight is linearly changed from one to zero. Then, the pointer is moved by $$L_s = \tau_{max}/(R-1)$$

on the waveform C, and is assumed to be a start point for the subsequent processing (shown by an inverse triangle in FIG. 3). The output signal with a length of $L_s+\tau_{max}=R\cdot\tau_{max}/(R-1)$ is made by the above-described processing, based on the signal with a length of $L_s$ to meet the companding ratio R.

The time-base companding processing by the PICOLA method in the time-base companding unit 4 has been executed as described above.

In the above time-base companding unit 4, time-base companding processing is executed for each of a left signal and a right one according to the PICOLA method. At this time, time-base companding can be executed without causing discomfort in the voices after conversion, because the channels are kept in synchronization with one another by using the common and fundamental frequency $\tau_{max}$ extracted in the feature extracting unit 3 for time-base companding of the left and right channels.

Finally, a digital signal is converted into an analog signal by digital-analog conversion of the left signal and the right one processed in the time-base companding unit 4 in the digital-to-analog converter 5.

Time-base companding of a stereo acoustical signal according to the first embodiment has been described as described above.

According to the first embodiment, high-quality time-base companding can be realized, because feature data common to each channel signal are extracted, based on a composite similarity obtained by combining the similarities which have been calculated from each channel signal forming a multichannel acoustical signal; feature data common to all channels can be accurately extracted by time compression and time expansion of the multichannel acoustical signal, based on the extracted feature data; and time companding can be processed under a state in which all channels are kept in synchronization with one another, based on the obtained common feature data.

Moreover, the amount of calculations required for extracting feature data can be greatly reduced by calculation under a state in which samples are thinned out, when a composite similarity is calculated, and a maximum similarity is searched.

Furthermore, it is possible to prevent reduction in the time resolution for all channels by executing thinning-out processing at different positions for each channel in the calculation of a composite similarity.

Here, when the number of channels is increased, for example, in the case of 5.1 channel acoustical signal, feature can be accurately extracted by extracting a feature using a composite similarity calculated from all channels or a part of channel signals without depending on phase relations among those of channels.

Then, a second embodiment according to the present invention will be explained, referring to FIG. 4, and FIG. 5. Here, parts similar to those previously described with reference to the first embodiment are denoted by the same reference numbers as those in the first embodiment, and explanation of the parts will be eliminated.

The acoustical-signal processing apparatus 1 shown as the first embodiment has illustrated an example, in which processing for extracting feature data common to the both channels from a left signal and a right one is executed by a hardware resource with a digital circuit configuration. On the other hand, the second embodiment will explain an example in which, processing for extracting feature data common to the both channels from a left signal and a right one is executed by a computer program installed in a hardware resource (for example, HDD and NVRAM) in an acoustical-signal processing apparatus.

Figure 4:
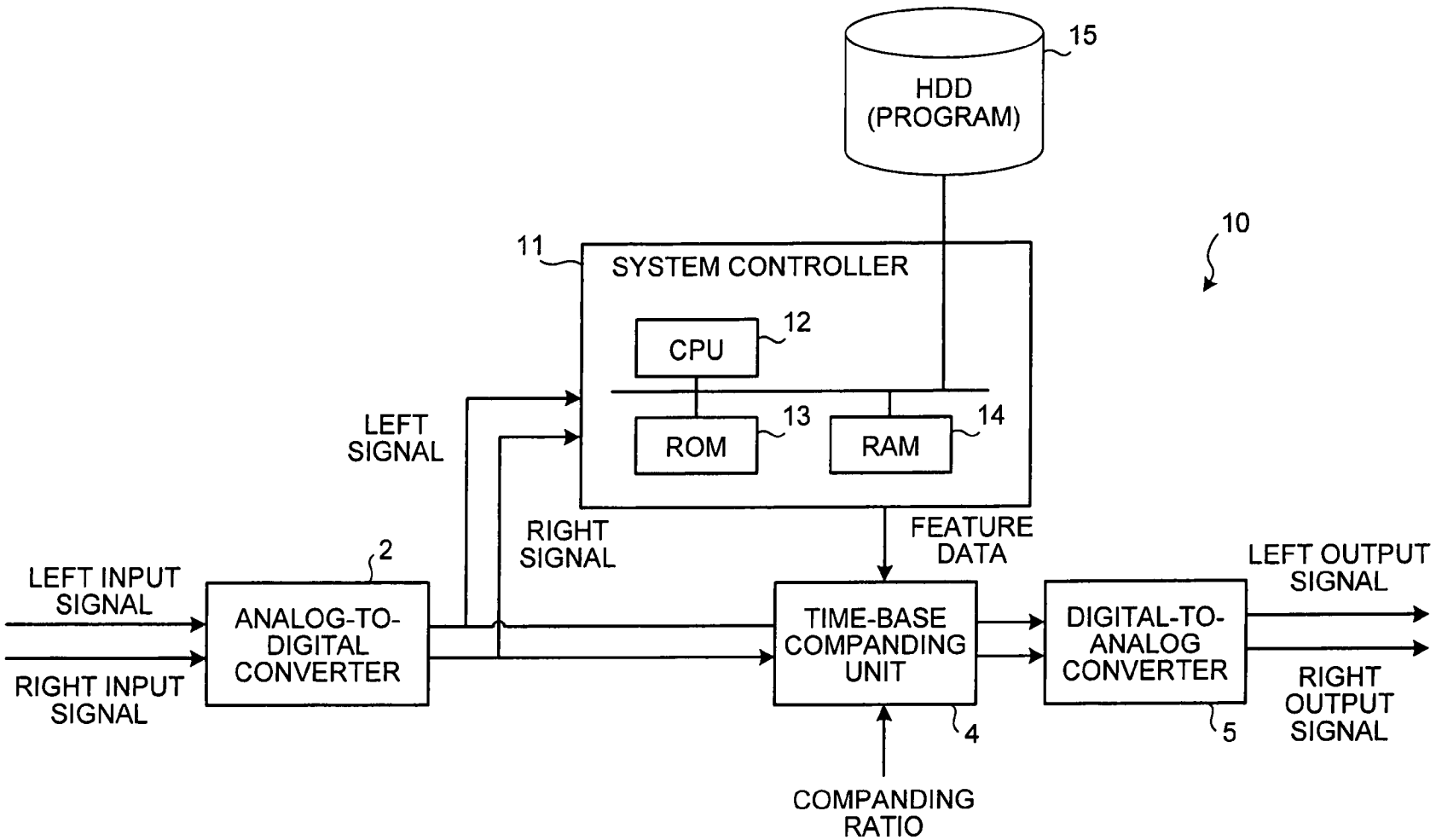
FIG. 4 is a block diagram showing a hardware resource in an acoustical-signal processing apparatus according to a second embodiment of this invention.
Figure 5:
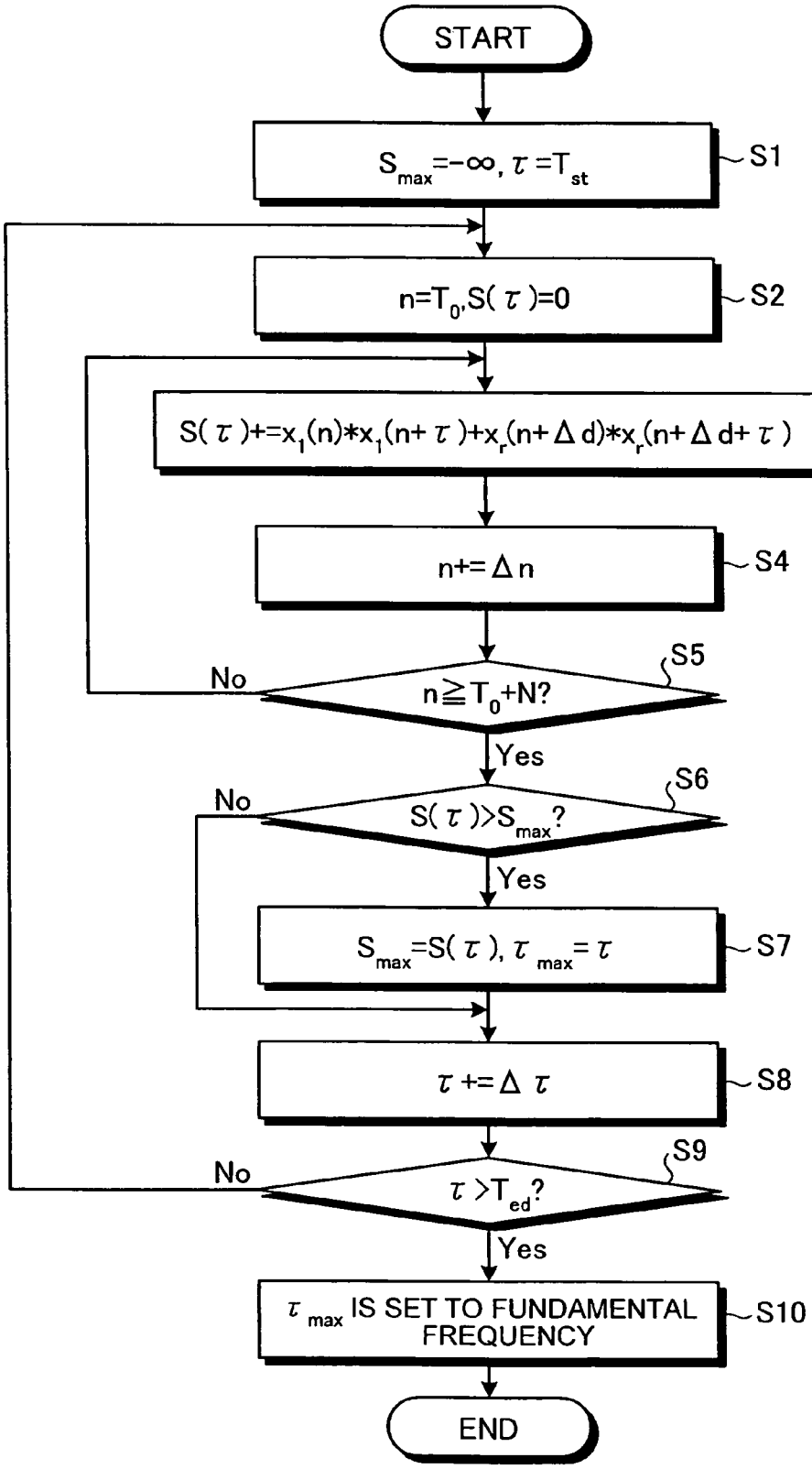
FIG. 5 is a flow chart showing a flow of feature extraction processing, by which feature data common to the both channels is extracted from a left signal and a right signal.

FIG. 4 is a block diagram showing a hardware resource in an acoustical-signal processing apparatus 10 according to the second embodiment of this invention. The acoustical-signal processing apparatus 10 according to this embodiment is provided with a system controller 11, instead of the feature extracting unit 3. The system controller 11 is a microcomputer comprising: a CPU (Central Processing Unit) 12 which controls the whole of the system controller 11; a ROM (Read Only Memory) 13 which stores a control program for the system controller 11; and a RAM (Random Access Memory) 14 which is a working memory for the CPU 12. And, there is provided a configuration in which a computer program for feature extraction processing for extracting feature data common to the both channels is a left signal and a right signal is installed in an HDD (Hard Disk Drive) 15 connected to the system controller 11 through a bus beforehand, and such a computer program is written in the RAM 14 at starting the acoustical-signal processing apparatus 10, and is executed, wherein feature data common to the both channels is extracted from a left signal and a right one by the computer program for feature extraction processing. That is, the computer program causes the system controller 11 of a computer to execute the feature extraction processing for extracting feature data common to the both channels from a left signal and a right signal. In this sense, the HDD 15 functions as a storage medium storing the computer program of an acoustical-signal processing program.

Hereinafter, the feature extraction processing for extracting feature data common to the both channels from a left signal and a right signal, which is executed according to the computer program, will be explained, referring to a flow chart shown in FIG. 5. As shown in FIG. 5, assuming that a start position for companding processing is $T_0$, the CPU 12 sets a parameter $\tau$ representing a position for searching for a similar waveform at $T_{ST}$ first, and, at the same time, $S_{max}$=−is given as an initial value of a maximum composite similarity (step S1).

Subsequently, assuming that time n is $T_0$, and a composite similarity $S(\tau)$ at a search position $\tau$ is 0 (step S2), the composite similarity $S(\tau)$ is calculated (step S3). In the calculation of the composite similarity $S(\tau)$, time n is increased by $\Delta n$ (step S4), and the operation at step S4 is repeated till the time n becomes larger than $T_0$+N (Yes at step S5).

When the time n becomes larger than $T_0$+N (Yes at step S5), the processing proceeds to step S6, at which a calculated composite similarity $S(\tau)$ and $S_{max}$ are compared. When the calculated composite similarity $S(\tau)$ is larger than $S_{max}$ (Yes at step S6), $S_{max}$ is replaced by the calculated composite similarity $S(\tau)$, and, at the same time, $\tau$ obtained in this case is assumed to be $\tau_{max}$ (step S7) for proceeding to step S8. On the other hand, when the calculated composite similarity $S(\tau)$ is smaller than $S_{max}$ (No at step S6), the processing proceeds to step S8 as it is.

The above processing at step S2 through step S7 is executed till $\tau$ exceeds $T_{ED}$ (Yes at step S9) after $\tau$ is increased by $\Delta\tau$ (step S8), and $\tau_{max}$ at the maximum composite similarity $S_{max}$, which has been finally obtained, is assumed to be a fundamental frequency (feature data) common to a left signal and a right one (step S10).

As described above, high-quality time-base companding can be realized according to the present invention, because feature data common to each channel signal are extracted, based on a composite similarity obtained by combining the similarities which have been calculated from each channel signal forming a multichannel acoustical signal; feature data common to all channels can be accurately extracted by time compression and time expansion of the multichannel acoustical signal, based on the extracted feature data; and time companding can be processed under a state in which all channels are kept in synchronization with one another, based on the obtained common feature data.

Here, the computer program of an acoustical-signal processing program installed in the HDD 15 is recorded in the storage medium, for example, a piece of optical information recording media such as a compact disc read-only memory (CD-ROM) and a digital versatile disc read-only memory (DVD-ROM), and a piece of magnetic media such as a floppy disk (FD). The computer program recorded in the above storage medium is installed in the HDD 15. Thereby, a storage medium in which the computer program of an acoustical-signal processing program is stored may be a portable storage medium, for example, optical information recording media such as a CD-ROM, and magnetic media such as an FD. Furthermore, it is also possible that the computer program of an acoustical-signal processing program is taken from the outside through, for example, a network, and is installed in the HDD 15.

Subsequently, a third embodiment according to the present invention will be explained, referring to FIG. 6. Here, parts similar to those previously described with reference to the first embodiment are denoted by the same reference numbers as those in the first embodiment, and explanation of the parts will be eliminated.

The acoustical-signal processing apparatus 1 shown as the first embodiment has a configuration in which the sum of the values of the auto-correlation function for the waveforms of each channel, that is, the composite similarity $S(\tau)$ obtained by combining (adding) the similarities of each channel is calculated; the fundamental frequency $\tau_{max}$ at the maximum value of the composite similarities $S(\tau)$ is assumed to be a fundamental frequency (feature data) common to the left signal and the right one; and the common and fundamental frequency $\tau_{max}$ is used for time-base companding of the left and right channels. The present embodiment has a configuration in which the sum of the absolute values of the differences in the amplitudes for the waveforms of each channel, that is, the composite similarity $S(\tau)$ obtained by combining (adding) the similarities of each channel is calculated; the fundamental frequency $\tau_{min}$ at the minimum value of the composite similarities $S(\tau)$ is assumed to be a fundamental frequency (feature data) common to the left signal and the right one; and the common and fundamental frequency $\tau_{min}$ is used for time-base companding of the left channel and the right one.

Figure 6:
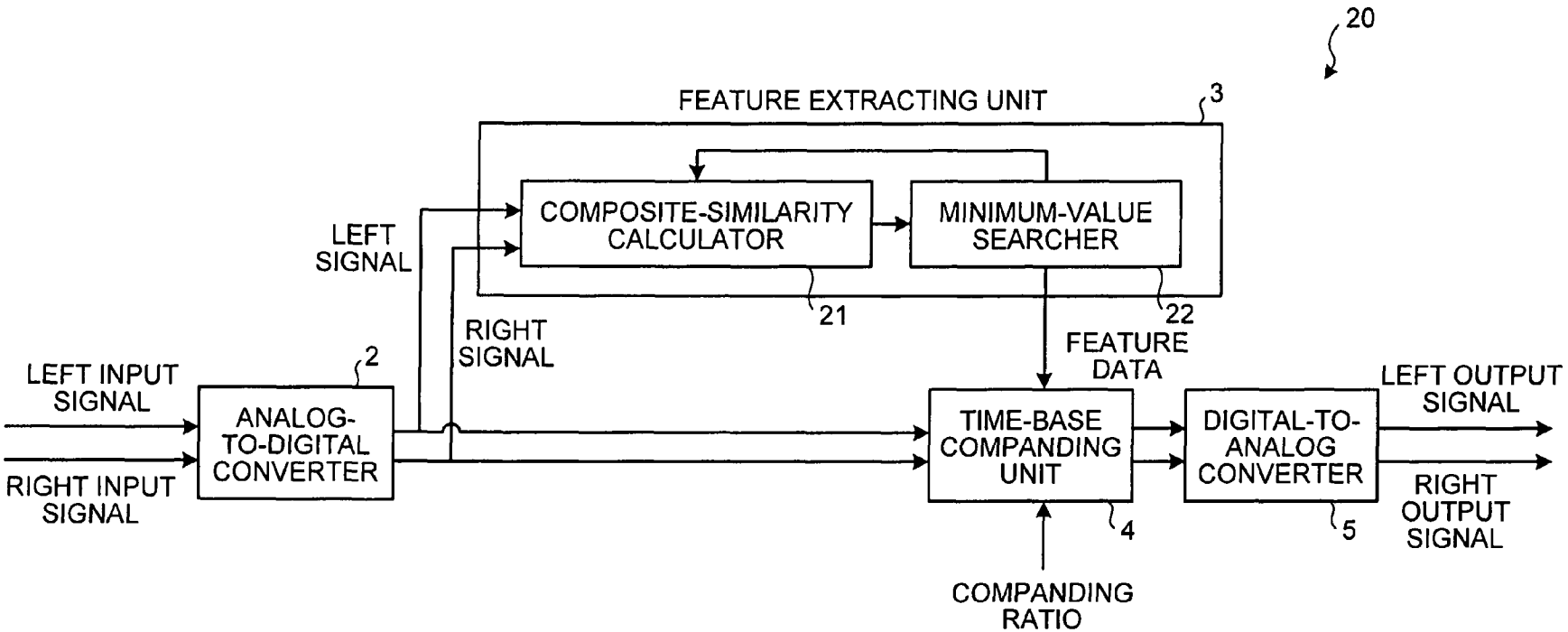
FIG. 6 is a block diagram showing a configuration of an acoustical-signal processing apparatus according to a third embodiment of this invention.

FIG. 6 is a block diagram showing a configuration of an acoustical-signal processing apparatus 20 according to the third embodiment of this invention. As shown in FIG. 6, the acoustical-signal processing apparatus 20 comprises: an analog-to-digital converter 2 for analog-to-digital conversion of a left signal and a right signal at a predetermined sampling frequency; a feature extracting unit 3 for extracting feature data common to the both channels from a left signal and a right one output from the analog-to-digital converter 2; a time companding unit 4 for performing, based on the feature data extracted in this feature extracting unit 3 and is common to the left channel and the right one, time-base companding processing of the input original digital signal according to a specified companding ratio, is executed: and a digital-to-analog converter 5 which outputs the left output signal and the right output one, which are obtained by digital to analog conversion of digital signals of each channel after processed in the time-base companding unit 4.

The feature extracting unit 3 comprises: a composite-similarity calculator 21 for calculating a composite similarity by using the left signal and the right one; and a minimum-value searcher 22 for determining a search position at which the composite similarity obtained in the composite-similarity calculator 21 is minimized.

In the composite-similarity calculator 21 of the feature extracting unit 3, the composite similarity between two intervals separated in the time-base direction is calculated for the left digital signal and the right digital one from the analog-to-digital converter 2. The composite similarity can be calculated, based on equation (2):

$$S(\tau) = \sum_{n=0, n+=\Delta n}^{N-1} \left( \begin{array}{c} |x_l(n) - x_l(n+\tau)| + \\ |x_r(n+\Delta d) - x_r(n+\Delta d+\tau)| \end{array} \right) \quad (2)$$

where $X_l(n)$ represents a left signal at time n, $X_r(n)$ represents a right signal at time n, N represents a width of a waveform window for calculation of the composite similarity, $\tau$ represents a search position for a similar waveform, $\Delta n$ represents a thinning-out width for calculation of the composite similarity, and $\Delta d$ represents a displacement in the thinning-out width between the left channel and the right one.

In equation (2), the composite similarity between two waveforms separated in the time direction is calculated by the sum of the absolute values of the differences in the amplitudes, and the composite similarity $s(\tau)$ is calculated by combining (adding) the sum of the absolute values of the differences in the amplitudes for a left signal and a right one at a search position $\tau$. The smaller composite similarity $s(\tau)$ causes the higher average similarity between a waveform with a length of N from time n as a starting point, and a waveform with a length of N from time $n+\tau$ as a starting point for a left channel and a right one.

In the minimum-value searcher 22 of the feature extracting unit 3, a search position $\tau_{min}$, at which a composite similarity becomes the minimum, is searched in a range for searching a similar waveform. When the composite similarity is calculated by equation (2), it is required only to search for the minimum value of $s(\tau)$ between a predetermined start position $P_{st}$ for searching and a predetermined end position $P_{ed}$ for searching.

As described above, high-quality time-base companding can be realized according to the third embodiment, because feature data common to each channel signal are extracted, based on a composite similarity obtained by combining the similarities calculated from each channel signal forming a multichannel acoustical signal; feature data common to all channels can be accurately extracted by time compression and time expansion of the multichannel acoustical signal, based on the extracted feature data; and time companding can be processed under a state in which all channels are kept in synchronization with one another, based on the obtained common feature data.

Figure 7:
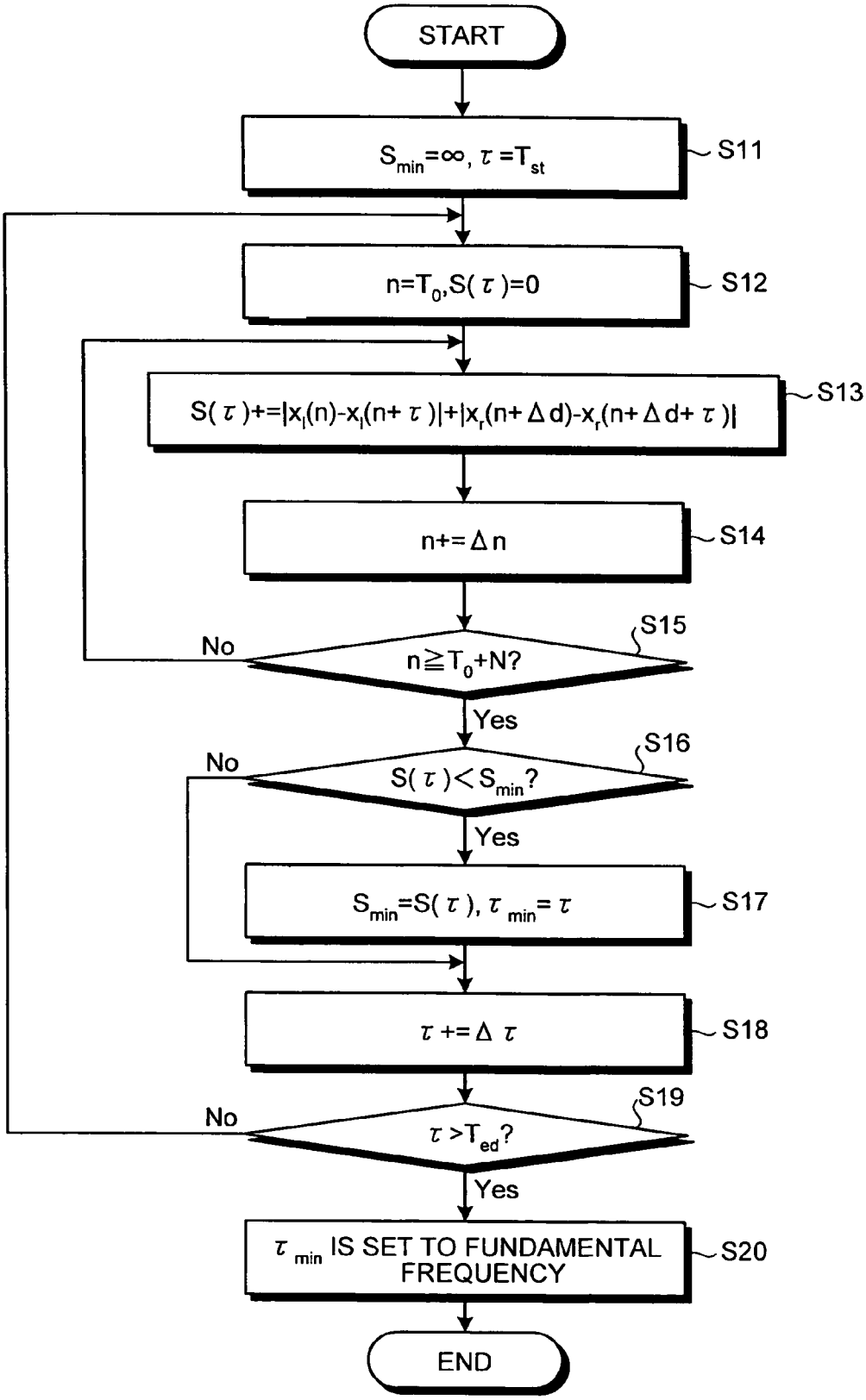
FIG. 7 is a flow chart showing a flow of feature extraction processing in an acoustical-signal processing apparatus according to a fourth embodiment of this invention.

Then, a fourth embodiment according to the present invention will be explained, referring to FIG. 7. Here, parts similar to those previously described with reference to the first embodiment through the third embodiment are denoted by the same reference numbers as those in the first embodiment through the third embodiment, and explanation of the parts will be eliminated.

The acoustical-signal processing apparatus 20 shown as the third embodiment is illustrated an example, in which processing for extracting feature data common to the both channels from a left signal and a right one is executed by a hardware resource with a digital circuit configuration. On the other hand, the present embodiment will explain an example in which, processing for extracting feature data common to the both channels from a left signal and a right one is executed by a computer program installed in a hardware resource (for example, HDD) in an information processor.

As there is no difference between the hardware configuration of the acoustical-signal processing apparatus in this embodiment and that of the acoustical-signal processing apparatus 10 explained in the second embodiment, the explanation will be eliminated. The acoustical-signal processing apparatus in this embodiment is different from the acoustical-signal processing apparatus 10 explained in the second embodiment in the computer program installed in the HDD 15, wherein the computer program is provided for feature extraction processing by which feature data common to the both channels is extracted from a left signal and a right signal.

Hereinafter, the feature extraction processing for extracting feature data common to the both channels from a left signal and a right signal, which is executed according to the computer program, will be explained referring to a flow chart shown in FIG. 7. As shown in FIG. 7, assuming that a start position for companding processing is $T_0$, the CPU 12 sets a parameter $\tau$ representing a position for searching for a similar waveform at $T_{ST}$ first, and, at the same time, $S_{min}$=is given as an initial value of a minimum composite similarity (step S11).

Subsequently, assuming that time n is $T_0$, and a composite similarity $S(\tau)$ at a search position $\tau$ is 0 (step S12), the composite similarity $S(\tau)$ is calculated (step S13). In the calculation of the composite similarity $S(\tau)$, time n is increased by $\Delta n$ (step S14), and the operation at step S14 is repeated till the time n becomes larger than $T_0$+N (Yes at step S15).

When the time n becomes larger than $T_0$+N (Yes at step S15), the processing proceeds to step S16, at which a calculated composite similarity $S(\tau)$ and $S_{min}$ are compared. When the calculated composite similarity $S(\tau)$ is smaller than $S_{min}$ (Yes at step S16), $S_{min}$ is replaced by the calculated composite similarity $S(\tau)$, and, at the same time, $\tau$ obtained in this case is assumed to be $\tau_{min}$ (step S17) for proceeding to step S18. On the other hand, when the calculated composite similarity $S(\tau)$ is larger than $S_{min}$ (No at step S16) the processing proceeds to step S18 as it is.

The above processing at step S12 through step S17 is executed till $\tau$ exceeds $T_{ED}$ (Yes at step S19) after $\tau$ is increased by $\Delta\tau$ (step S18), and $\tau_{min}$ at the minimum composite similarity $S_{min}$, which has been finally obtained, is assumed to be a fundamental frequency (feature data) common to a left signal and a right one (step S20).

According to the above-described embodiment, high-quality time-base companding can be realized, because feature data common to each channel signal are extracted, based on a composite similarity obtained by combining the similarities calculated from each channel signal forming a multichannel acoustical signal; feature data common to all channels can be accurately extracted by time compression and time expansion of the multichannel acoustical signal, based on the extracted feature data; and time companding can be processed under a state in which all channels are kept in synchronization with one another, based on the obtained common feature data.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An acoustical-signal processing apparatus, comprising:

a feature extracting unit that receives a multichannel acoustical signal and extracts feature data common to a left channel signal and a right channel signal included in the multichannel acoustical signal, based on a composite similarity obtained by combining similarities among the left channel signal and the right channel signal; and a time-base companding unit that receives the multichannel acoustical signal and executes time compression and time expansion of the multichannel acoustical signal based on the extracted feature data.

2. The acoustical-signal processing apparatus according to claim 1, wherein the feature extracting unit comprises:

a composite-similarity calculator that calculates a composite similarity which is a sum of values of an auto-correlation function for waveforms of each channel signal; and a maximum-value searcher that searches for a maximum value of the calculated composite similarity, to extract the maximum value as the feature data.

3. The acoustical-signal processing apparatus according to claim 1, wherein the feature extracting unit comprises:

a composite-similarity calculator that calculates a composite similarity which is a sum of values of absolute values of amplitude differences for waveforms of each channel signal and which is obtained by combining similarities; and a minimum-value searcher that extracts feature data common to each channel signal by searching for a minimum value of the calculated composite similarity.

4. The acoustical-signal processing apparatus according to claim 1, wherein a composite similarity is calculated by thinning out a number of samples for similarity calculation of each channel signal.

5. The acoustical-signal processing apparatus according to claim 4, wherein thinning-out positions for each channel signal are different from one another, when the number of samples for similarity calculation of each channel signal is thinned out.

6. The acoustical-signal processing apparatus according to claim 2, wherein a desired composite similarity is searched by thinning out search positions for a similar waveform in a time-base direction.

7. The acoustical-signal processing apparatus according to claim 3, wherein a desired composite similarity is searched by thinning out search positions for a similar waveform in a time-base direction.

8. The acoustical-signal processing apparatus according to claim 4, wherein a thinning-out width is determined by a number of channels of the multichannel acoustical signals.

9. The acoustical-signal processing apparatus according to claim 4, wherein a thinning-out width is determined according to a specified companding ratio.

10. The acoustical-signal processing apparatus according to claim 1, wherein the time-base companding unit executes time compression and time expansion of the multichannel acoustical signal with all channels kept in synchronization based on the extracted feature data.

11. A computer program product having a non-transitory computer readable medium including programmed instructions stored thereon for processing an acoustical-signal, wherein the instructions, when executed by a computer, cause the computer to perform:

extracting feature data from a multichannel acoustical signal common to a left channel signal and a right channel signal included in the multichannel acoustical signal, based on a composite similarity obtained by combining similarities among the left channel signal and the right channel signal; and executing time compression and time expansion of the multichannel acoustical signal based on the extracted feature data.

12. The computer program product according to claim 11, the instructions further cause the computer to perform:

calculating a composite similarity which is a sum of values of an auto-correlation function for waveforms of each channel signal; and searches for a maximum value of the calculated composite similarity, to extract the maximum value as the feature data.

13. The computer program product according to claim 11, the instructions further cause the computer to perform executing time compression and time expansion of the multichannel acoustical signal with all channels kept in synchronization based on the extracted feature data.

14. The computer program product according to claim 11, the instructions further cause the computer to perform:

calculating a composite similarity which is a sum of values of absolute values of amplitude differences for waveforms of each channel signal and which is obtained by combining similarities; and extracting feature data common to each channel signal by searching for a minimum value of the calculated composite similarity.

15. An acoustical-signal processing method, comprising:

extracting feature data from a multichannel acoustical signal common to a left channel signal and a right channel signal included in the multichannel acoustical signal, based on a composite similarity obtained by combining similarities among the left channel signal and the right channel signal; and executing time compression and time expansion of the multichannel acoustical signal based on the extracted feature data.

16. The acoustical-signal processing method according to claim 15, further comprising:

calculating a composite similarity which is a sum of values of an auto-correlation function for waveforms of each channel signal; and searches for a maximum value of the calculated composite similarity, to extract the maximum value as the feature data.

17. The acoustical-signal processing method according to claim 15, further comprising:

calculating a composite similarity which is a sum of values of absolute values of amplitude differences for waveforms of each channel signal and which is obtained by combining similarities; and extracting feature data common to each channel signal by searching for a minimum value of the calculated composite similarity.

* * * * *